United States Patent [19]

Lundström et al.

[11] Patent Number: 4,918,889

[45] Date of Patent: Apr. 24, 1990

[54] HIGH-RISE BUILDING

[76] Inventors: Björn Lundström, Vasavägen 37, S-181 42 Lidingö; Olle Rex, Attundavägen 6, S-161 52 Bromma, both of Sweden

[21] Appl. No.: 398,744

[22] Filed: Aug. 25, 1989

[30] Foreign Application Priority Data

Aug. 26, 1988 [SE] Sweden ..... 8802994

[51] Int. Cl.[5] ..... E04H 1/00

[52] U.S. Cl. ..... 52/234; 52/30; 52/236.3; 52/236.4

[58] Field of Search ..... 52/234, 30, 236.3, 236.4

[56] References Cited

U.S. PATENT DOCUMENTS 3,839,833 10/1974 Steele ..... 52/234 X
4,525,975 7/1985 McWethy ..... 52/234 X
4,736,556 4/1988 Scizak ..... 52/236.3 X

FOREIGN PATENT DOCUMENTS 0996696 2/1983 U.S.S.R. ..... 52/234

*Primary Examiner*—David A. Scherbel
*Assistant Examiner*—Lan Mai
*Attorney, Agent, or Firm*—Michael, Best & Friedrich

[57] ABSTRACT

A high-rise building comprising a plurality of storeys (5) is characterized in that two or more units (1–1*c*) of mutually superimposed storeys (5,6) of the plurality of storeys are arranged one on the other. Each storey unit (1–1*c*) has a common, garden area (7) located within the confines of the building and has a ground floor on the same level as the lowermost storey of the unit. Each storey unit is served by an elevator and staircase arrangement which is restricted to the unit in question and which is accessible from the ground floor of the garden area (7). Finally, the garden areas (7) are mutually connected by means of separate elevators and staircases from the lowermost storeys of respective units of the high-rise building.

8 Claims, 2 Drawing Sheets

HIGH-RISE BUILDING

The present invention relates to a high-rise building consisting of many stories built one upon the other, such as to form said building.

One economic solution to the high and progressively increasing cost of building ground, particularly in densely populated areas, is to erect high-rise buildings, such as to provide the maximum disposable building area on the minimum area of building ground. Technically speaking, there is no obstacle which will prevent the construction of very tall buildings. The economic benefits gained from high-rise buildings, however, shall be weighed against the drawbacks associated with such buildings from, inter alia, an environmental aspect. The hard wear to which elevators (lifts), entrance halls, lobbies, the bottom storeys and stair-wells or stair enclosures are subjected is viewed negatively and with displeasure. This is particularly true of high-rise apartment buildings or high-rise buildings which combine living apartments and offices.

Since many systems are common to the traditional high-rise building, from the basement storey to the highest or top storey, for instance such services as elevators and ventilation systems, fire outbreaks in high-rise buildings can take a disastrous course. Fire protection in high-rise buildings therefore presents a serious problem.

The object of the present invention is to eliminate the technical and emotional drawbacks associated with high-rise buildings and to impart to traditional high-rise buildings many of the qualities of iow-rise buildings, in a manner not hitherto achieved. This object is realized with the present invention, the characterizing features of which are set forth in the following claims and which enables attractive dwellings to be constructed in city and town centres on ground space which is restricted to the ground space used for traditional high-rise buildings.

The invention will now be described in more detail with reference to an exemplifying embodiment thereof illustrated in drawings.

FIG. 2 is a schematic illustration of the lower is intended for shops and the like.

Figure 1:
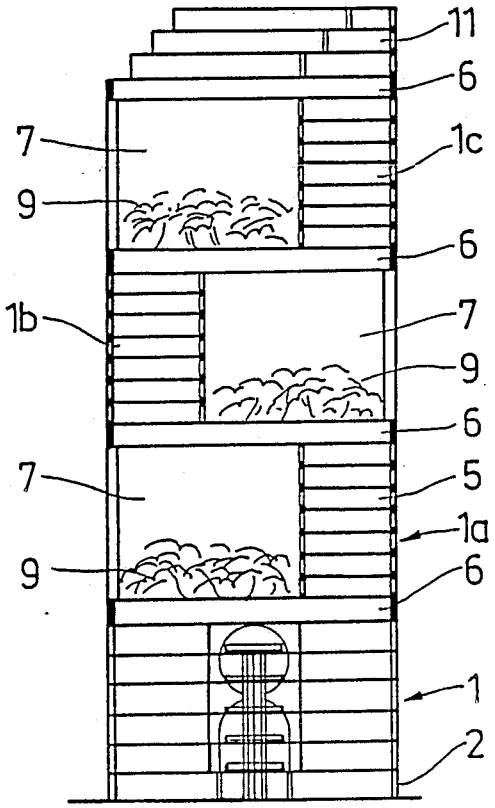
FIG. 1 is a schematic illustration in side view of a high-rise building constructed in accordance with the invention.
Figure 2:
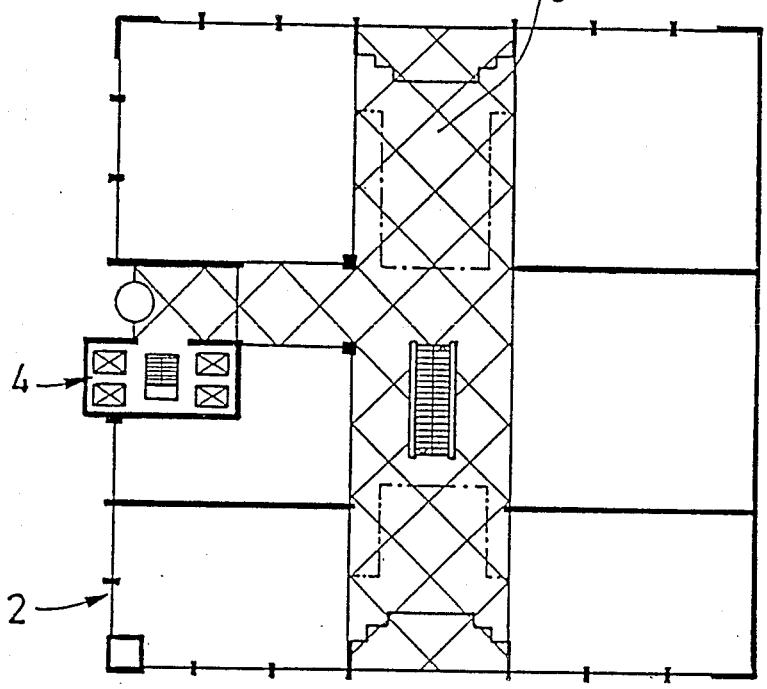

The high-rise building illustrated in FIG. 1 comprises four blocks or building units 1, 1*a*, 1*b* and 1*c*, each of which includes a given number of storeys. The lowermost of the units 1 of the illustrated embodiment is a combined shop and office building structure, wherein the bottom storey 2 may appropriately accommodate shop or like businesses, as illustrated schematically by way of example in FIG. 2. In this illustration, the reference number 3 identifies an entrance hall or lobby and the reference number 4 identifies an elevator and staircase system. In the case of the illustrated embodiment, the bottom building unit 1 includes six storeys. Placed on the unit 1 is a further building unit 1*a*, which includes seven mutually superimposed storeys 5, these storeys consisting of dwelling apartments in the illustrated case. Located between the unit 1*a* consisting of apartment storeys 5 and the bottom unit 1 is a service storey 6 in which heating, water, sanitation and electrical systems are arranged. The storey 6 can also be used as a storage facility and as a supply store.

Figure 3:
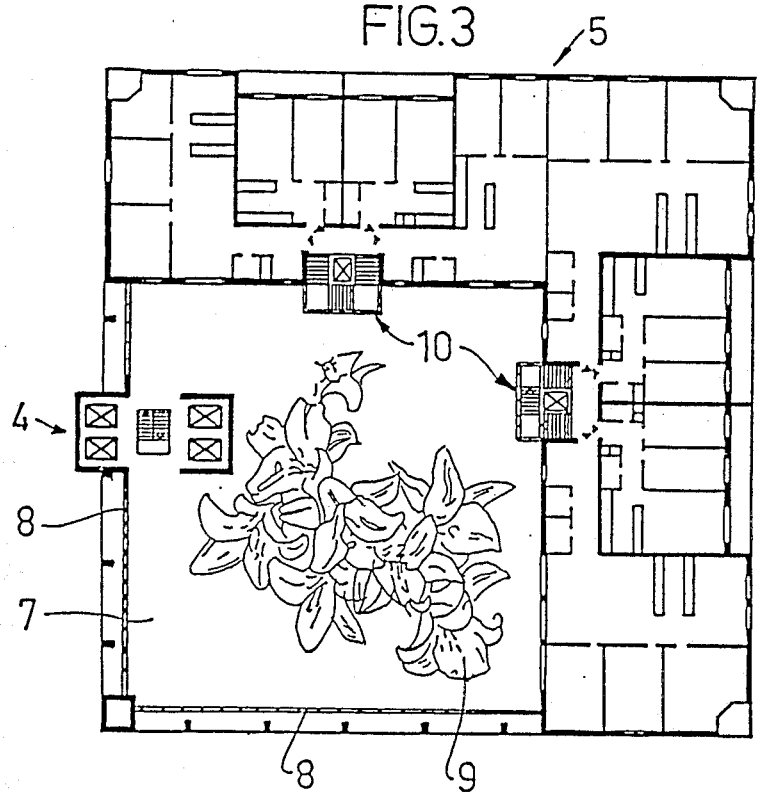
FIG. 3 is a schematic illustration of one storey.

The seven storeys of the unit 1*a* of the illustrated embodiment thus resemble traditional low-rise structures with respect to their measurements and storey heights. As illustrated in FIG. 3, the storeys are constructed from angularly positioned building units. Two sides of these building units border onto a climate area or winter garden 7, the remaining two sides 8 of which garden are completely covered-in with glass. The plants contained in the garden are referenced 9. Located above the unit 1*a* is a further unit 1*b*, with an intermediate service storey 6 located therebetween. In the case of the illustrated embodiment, a further building unit 1*c* is erected above the unit 1*b*, with a service storey 6 located therebetween. These storey units 1*a*–1*c* are, in principle, mutually identical and autonomous and may be rotated relative to one another, in the illustrated case with 90°. In the illustrated embodiment, three terrace storeys 11 are located on top of the building and its uppermost service storey Each unit 1*a*–1*c* of the storeys 5 is serviced by secondary elevators and stair cases 10, which operate and extend respectively from the "ground floor" of the winter garden 7 to the uppermost storey in the building unit. Consequently, it should not be possible to move between the different building units 1*a*, 1*b* and 1*c* with the aid of these elevators and staircases 10.

The various gardens 7 are interconnected by means of a primary elevator and staircase system 4, which mutually connects the "ground floors" of respective gardens 7. An elevator and staircase system extends from the lowermost garden 7 to the ground storey— the shop storey 2. This elevator system 4 can only be used to move between the gardens 7. It is possible to provide a primary, common elevator and staircase system 4 for interconnecting all gardens, irrespective of the mutual orientation of the building units 1*a*–1*c* or the location of the gardens 7.

Figure 4:
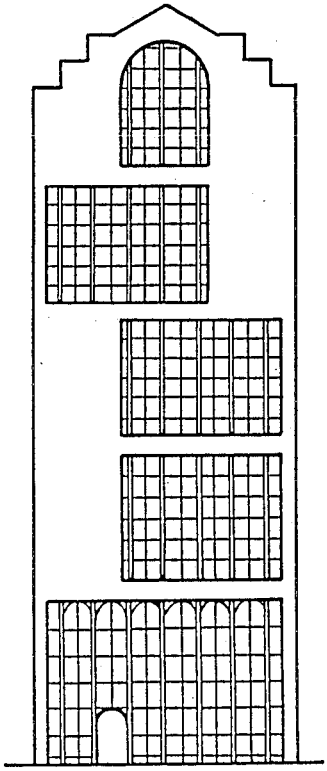
FIG. 4 is a schematic illustration of an inventive high-rise building structure which has an appearance different to that of the building shown in FIG. 1.

FIG. 4 illustrates by way of example only another architectural configuration of the invention, and it will be understood that it is possible-to vary the building units with respect to their configuration and the number of storeys contained therein, within the scope of the invention.

In summary, it can be said that the inventive high-rise building consists of a plurality of mutually superimposed blocks of storeys, wherein each block forms an authonomous building unit incorporated in the total high-rise building structure.

A specific feature of the high-rise building is that each building unit has its own glassed-in and attempporated garden area. The communication system of the high-rise building consists of two mutually separated but mutually coacting elevator and staircase systems.

The primary system connects the bottom storeys—"-the ground floors"—of respective building units together. The second area system of the communication system connects the various storeys within respective building units. Located between respective building units is a storey intended, inter alia, for technical installations.

We claim:

1. A high-rise building comprising a plurality of storeys, characterized in that two or more units of superimposed storeys of said plurality of storeys are arranged on top of one another; in that each storey unit has a common garden area located within the confines of the high-rise building limiting area with a garden floor area on the same level as the lowermost storey of the unit; in that each storey unit is served by an elevator and staircase arrangement which is restricted to its respective storey unit and accessable from the garden floor area of the lowermost storey of the unit; and in that the garden areas are mutually connected from the ground floors of the lowermost storeys of respective units of the high-rise building by means of separate elevators and staircases.

2. A high-rise building according to claim 1, characterized in that a service storey which accommodates heating, water, sanitation and electrical systems etc., is located between respective storey units.

3. A high-rise building according to claim 1 or 2, characterized in that the garden areas are enclosed in glass.

4. A high-rise building according to claim 2, characterized in that the lowermost unit forms a shop area.

5. A high-rise building according to claim 3, characterized in that the lowermost unit forms a shop area.

6. A high-rise building according to claim 1, characterized in that the garden areas are enclosed in glass.

7. A high-rise building according to claim 6, characterized in that the lowermost unit forms a shop area.

8. A high-rise building according to claim 1, characterized in that the lowermost unit forms a shop area.

* * * * *

UNITED STATES PATENT AND TRADEMARK OFFICE

CERTIFICATE OF CORRECTION

PATENT NO. : 4,918,889

DATED : April 24, 1990

INVENTOR(S) : Bjorn Lundstrom et al.

It is certified that error appears in the above-identified patent and that said Letters Patent is hereby corrected as shown below:

Column 1, line 43, after the word "in", insert ---the accompanying---.

Column 1, line 47, after the word "lower", insert ---storey, which---

Column 4, line 3, delete ---1 or---.

Signed and Sealed this

Eighth Day of October, 1991

*Attest:*

HARRY F. MANBECK, JR.

*Attesting Officer*

*Commissioner of Patents and Trademarks*